US005670760A

United States Patent [19]

Christy

[11] Patent Number: 5,670,760

[45] Date of Patent: Sep. 23, 1997

[54] MULTI-SWITCH MEMBRANE-SWITCH ASSEMBLY

[75] Inventor: Scott Thomas Christy, Franklin, Wis.

[73] Assignee: Golden Books Publishing Company, Inc., West Allis, Wis.

[21] Appl. No.: 547,304

[22] Filed: Oct. 24, 1995

[51] Int. Cl.[6] ..... H01H 13/70

[52] U.S. Cl. ..... 200/5 A; 200/512

[58] Field of Search ..... 200/5 R, 5 A, 200/61.54–61.57, 85 R, 86 R, 85 A, 512–517

[56] References Cited

U.S. PATENT DOCUMENTS

| | | | |
|---|---|---|---|
| 2,823,279 | 2/1958 | Schulenburg | 200/86 R |
| 3,838,236 | 9/1974 | Wolf et al. | 200/61.56 |
| 3,860,771 | 1/1975 | Lynn et al. | 200/5 A |
| 3,917,917 | 11/1975 | Murata | 200/517 |
| 4,125,934 | 11/1978 | Keough et al. | 200/5 A X |
| 4,180,711 | 12/1979 | Hirata et al. | 200/5 A |
| 4,460,810 | 7/1984 | Fukukura | 200/5 A |
| 4,608,465 | 8/1986 | Harada | 200/5 A |
| 4,640,994 | 2/1987 | Komaki | 200/5 A |
| 4,684,767 | 8/1987 | Phalen | 200/5 A |
| 4,695,681 | 9/1987 | Velleman | 200/5 A |
| 4,706,536 | 11/1987 | Sanders | 200/5 A X |
| 4,720,610 | 1/1988 | MacHarrie | 200/5 A |
| 4,820,887 | 4/1989 | Schmitz | 200/5 A X |
| 4,975,676 | 12/1990 | Greenhalgh | 200/5 A X |
| 4,987,275 | 1/1991 | Miller et al. | 200/5 A |
| 5,072,077 | 12/1991 | Klein | 200/5 A |
| 5,175,443 | 12/1992 | Tabuchi | 200/5 R X |
| 5,199,555 | 4/1993 | Hirano | 200/341 |
| 5,209,665 | 5/1993 | Billings et al. | 200/5 A |
| 5,231,386 | 7/1993 | Brandenburg et al. | 345/174 |
| 5,357,065 | 10/1994 | Mitamura et al. | 200/5 A |

*Primary Examiner*—J. R. Scott
*Attorney, Agent, or Firm*—Amster, Rothstein & Ebenstein

[57] ABSTRACT

A multi-switch membrane-switch assembly includes a longitudinally extending, resiliently flexible, non-conductive membrane having a convexly bowed cross section defining on an undersurface thereof a plurality of interrupted circuits defining longitudinally aligned pairs of laterally spaced, conductive contacts. A rigid substrate defines on an oversurface thereof a plurality of longitudinally aligned, conductive shorting elements. A laterally spaced pair of longitudinally extending, non-conductive positioning ribs are disposed on the oversurface of the rigid substrate. Each positioning rib defines an undercut for receiving and maintaining a longitudinally extending edge of the membrane, the positioning ribs cooperating to maintain the membrane convexly bowed.

15 Claims, 3 Drawing Sheets

FIG. 1
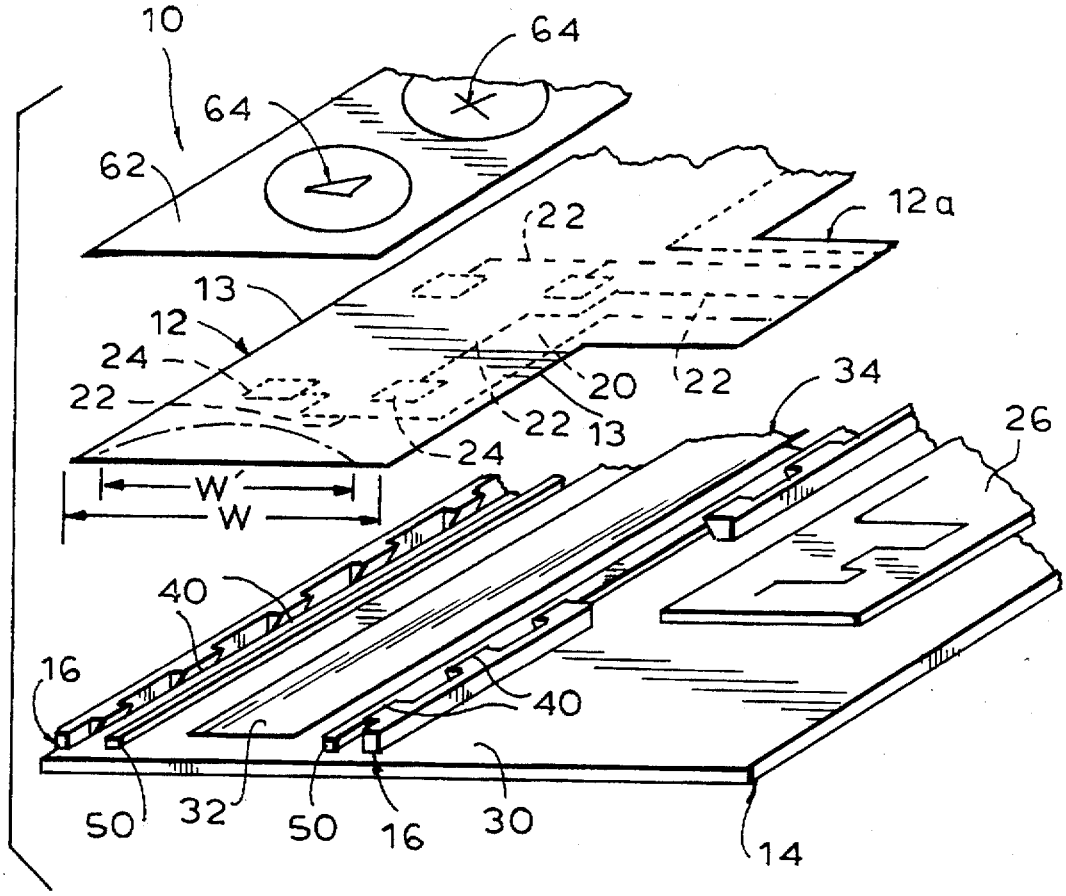
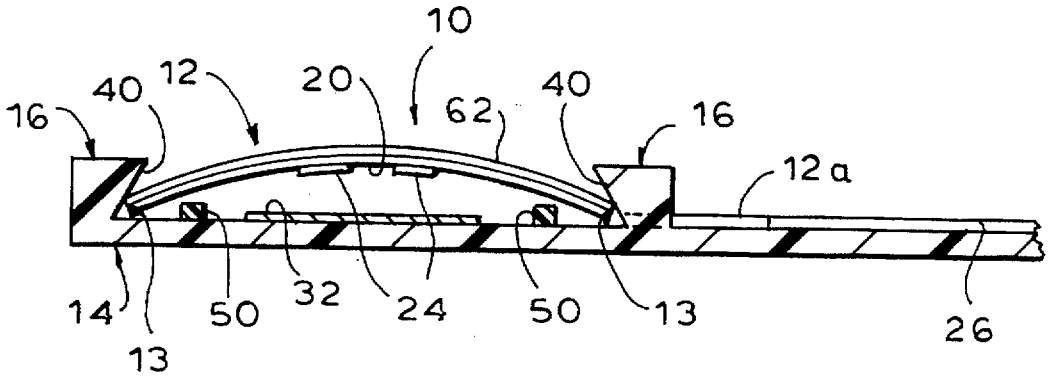
FIG. 2

MULTI-SWITCH MEMBRANE-SWITCH ASSEMBLY

BACKGROUND OF THE INVENTION

The present invention relates to a multi-switch membrane-switch assembly and, more particularly, to such an assembly which contains a plurality of membrane switches thereon without any spacers or dividers disposed intermediate the switches or intermediate the membrane and the rigid substrate therebelow.

It is well known to provide a multi-switch membrane-switch assembly—that is, an assembly containing a plurality of membrane switches. In a very primitive form, this is done by simply securing on a common support a plurality of self-standing membrane switches, each with its own membrane and rigid substrate. In a slightly advanced form, a plurality of membrane switches share a common rigid substrate. In both of these simple forms the membrane of each switch may be flat or domed (i.e., hemispherical).

In a more sophisticated form, the assembly is formed of a single common membrane which is essentially co-extensive with the single common rigid substrate. Customarily the common membrane defines on an undersurface thereof one plurality of (a) a plurality of interrupted circuits defining longitudinally aligned pairs of laterally spaced contacts and (b) a plurality of longitudinally aligned, conductive shorting elements. The common rigid substrate defines on an oversurface thereof the other plurality (that is, either (a) the plurality of longitudinally aligned, conductive shorting elements or (b) the plurality of interrupted circuits defining longitudinally aligned pairs of laterally spaced, conductive contacts). Most typically the membrane defines the plurality of interrupted circuits, while the rigid substrate defines the conductive shorting elements.

In order to prevent the accidental actuation of more than one switch at a time in the more sophisticated form, one or more switch isolation techniques are employed. Thus, intermediate each pair of adjacent switches—each switch being formed by a portion of the common membrane and an underlying portion of the common rigid substrate—there may be interposed a non-conductive vertical rib or spacer, thereby to enable one of a group of adjacent switches to be actuated without actuation of the other switches of the group. These vertical spacers or ribs typically extend upwardly from the rigid substrate and support the membrane above the rigid substrate. As opposed to, or in addition to, the aforementioned vertical spacers or ribs, a horizontal spacer may be interposed or layered between the membrane and the rigid substrate, with appropriate cut-outs being provided in the spacer to enable contact to be made between the respective electrical components of the membrane and rigid substrate of each switch upon the appropriate application of pressure on the membrane. Both of these procedures for isolating the various switches of the assembly are effective and presently in commercial use.

On the other hand, each of these switch isolation techniques requires that the rigid substrate (or membrane) be formed with the vertical ribs or spacers disposed in the appropriate places for the particular arrangement of switches on the assembly, on the one hand, or that the horizontal spacers be formed with cut-outs suitably placed for the particular arrangement of switches on the assembly, on the other hand. Thus the switch isolating techniques presently in use do not lend themselves to generic or modular structures, but require the substantial expense of being custom tailored to a particular arrangement of switches on an assembly.

Accordingly, it is an object of the present invention to provide a multi-switch membrane-switch assembly which does not require either horizontal or vertical spacers in order to isolate one switch from another or to normally isolate the electrical components of a single switch from one another.

A further object is to provide such an assembly which is easy and economical to manufacture, use and maintain.

SUMMARY OF THE INVENTION

It has now been found that the above and related objects of the present invention are obtained in a multi-switch membrane-switch assembly comprising a membrane, a rigid substrate, and a pair of positioning ribs. The longitudinally extending, resiliently flexible, non-conductive membrane has a convexly bowed cross section defining on an undersurface thereof a plurality of interrupted circuits defining longitudinally aligned pairs of laterally spaced, conductive contacts. The rigid substrate defines on an oversurface thereof a plurality of longitudinally aligned, conductive shorting elements. The laterally spaced pair of longitudinally extending, non-conductive positioning ribs is disposed on the oversurface of the rigid substrate. Each positioning rib defining means for receiving and maintaining a longitudinally extending edge of the membrane, and the positioning ribs cooperate to maintain the membrane convexly bowed.

In a preferred embodiment, the receiving and maintaining means is an undercut on the positioning rib. The undercuts releasably receive and maintain the membrane, and preferably each of the positioning ribs defines a plurality of intermittent undercuts. The width of the membrane, when flat, exceeds the lateral distance between the undercuts of the positioning ribs, optimally by about 3.5 to 5.0% of the membrane width when flat. The membrane is polyester, preferably mylar. The plurality of conductive shorting elements are either longitudinally spaced apart or define a unitary conductive shorting pad. The assembly may additionally include a label disposed on an oversurface of the membrane, the label bearing a printed icon over each of the conductive shorting elements.

Preferably a laterally spaced pair of longitudinally extending, non-conductive guide ribs are disposed on the oversurface of the rigid substrate. The guide ribs are disposed closely adjacent and inwardly of the positioning ribs and cooperate with the positioning ribs to maintain the membrane convexly bowed.

In another embodiment, the membrane undersurface has one plurality of (a) a plurality of interrupted circuits defining longitudinally aligned pairs of laterally spaced, conductive contacts, and (b) a plurality of longitudinally aligned, conductive shorting elements, while the rigid substrate oversurface has the other plurality.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 a fragmentary exploded isometric view of an assembly according to the present invention;

FIG. 2 is a fragmentary sectional view of the assembly;

DETAILED DESCRIPTION OF THE PREFERRED EMBODIMENTS

Figure 3:
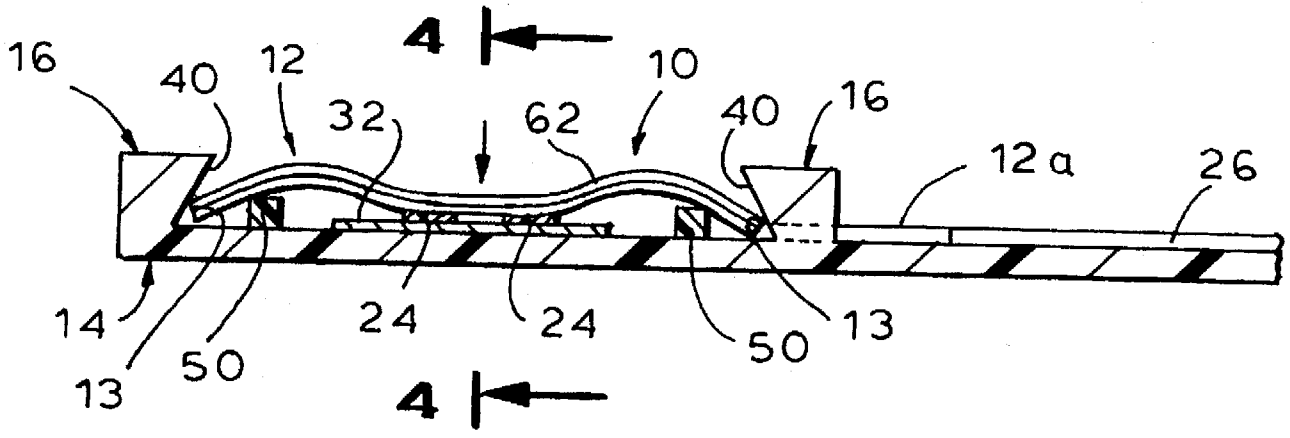
FIG. 3 is a fragmentary view similar to FIG. 2, but with one switch being actuated.

Referring now to the drawing, and in particular to FIG. 1 thereof, therein illustrated is a multi-switch membrane-switch assembly according to the present invention, generally designated by the reference numeral 10. In its essential aspects the assembly 10 comprises a longitudinally extending, resiliently flexible, non-conductive membrane, generally designated 12, rigid substrate, generally designated 14, and a laterally spaced pair of longitudinally extending, non-conductive positioning ribs, generally designated 16. Each of these components will now be discussed in turn.

Figure 4:
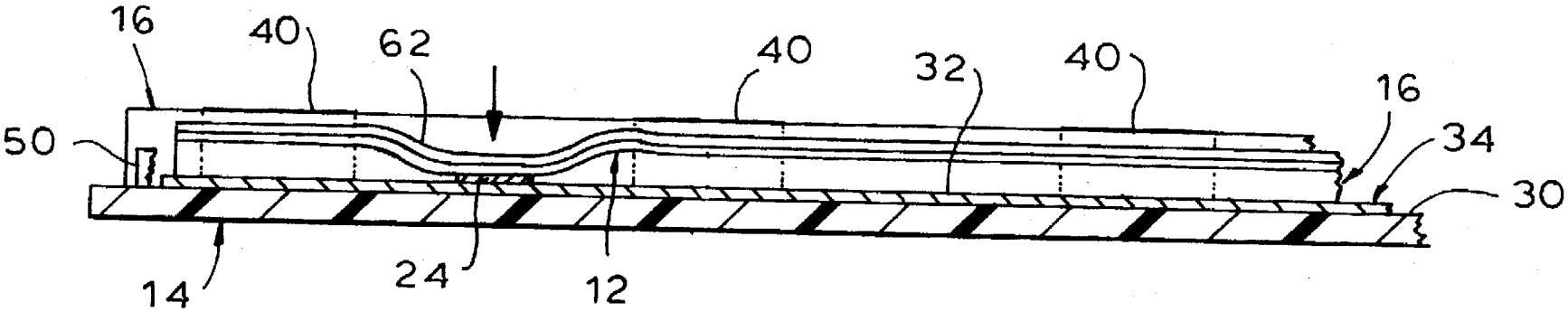
FIG. 4 is a fragmentary sectional view taken along the line 4—4 of FIG. 3, with a portion of a guide rib cut away to reveal details of the inner construction.

Illustrated in FIG. 1 in its flat or unstressed orientation is the longitudinally extending, resiliently flexible, non-conductive membrane 12. It will be appreciated, however, that when the membrane 12 is disposed in the assembly with its longitudinal edges 13 received in the respective positioning ribs 16, the membrane 12 will have a convexly bowed cross section as illustrated in FIGS. 2–4. The membrane is preferably formed of a resiliently flexible polyester such as Mylar and may have a thickness of about 0.1 mm.

The undersurface 20 of the membrane 12 defines a plurality of interrupted circuits 22 best seen in FIG. 1. The interrupted circuits 22 themselves define at the point of interruption a pair of laterally spaced conductive contacts 24. The pairs of laterally spaced conductive contacts 24 of each interrupted circuit 22 are longitudinally aligned along a longitudinal axis of the membrane 12. By means of a membrane extension 12*a* extending laterally therefrom to a printed circuit board (PCB) 26 or other electronic circuit, each interrupted circuit 22 can be made to perform a useful function depending on whether the controlling switch is open or closed.

It will be appreciated that the only essential restriction on the plurality of interrupted circuits 22 disposed on the undersurface 20 of the membrane 12 is that the pairs of laterally spaced, conductive contacts 24 be longitudinally aligned. The significance of the longitudinal alignment of the contact pairs will become apparent hereinafter.

Figure 5:
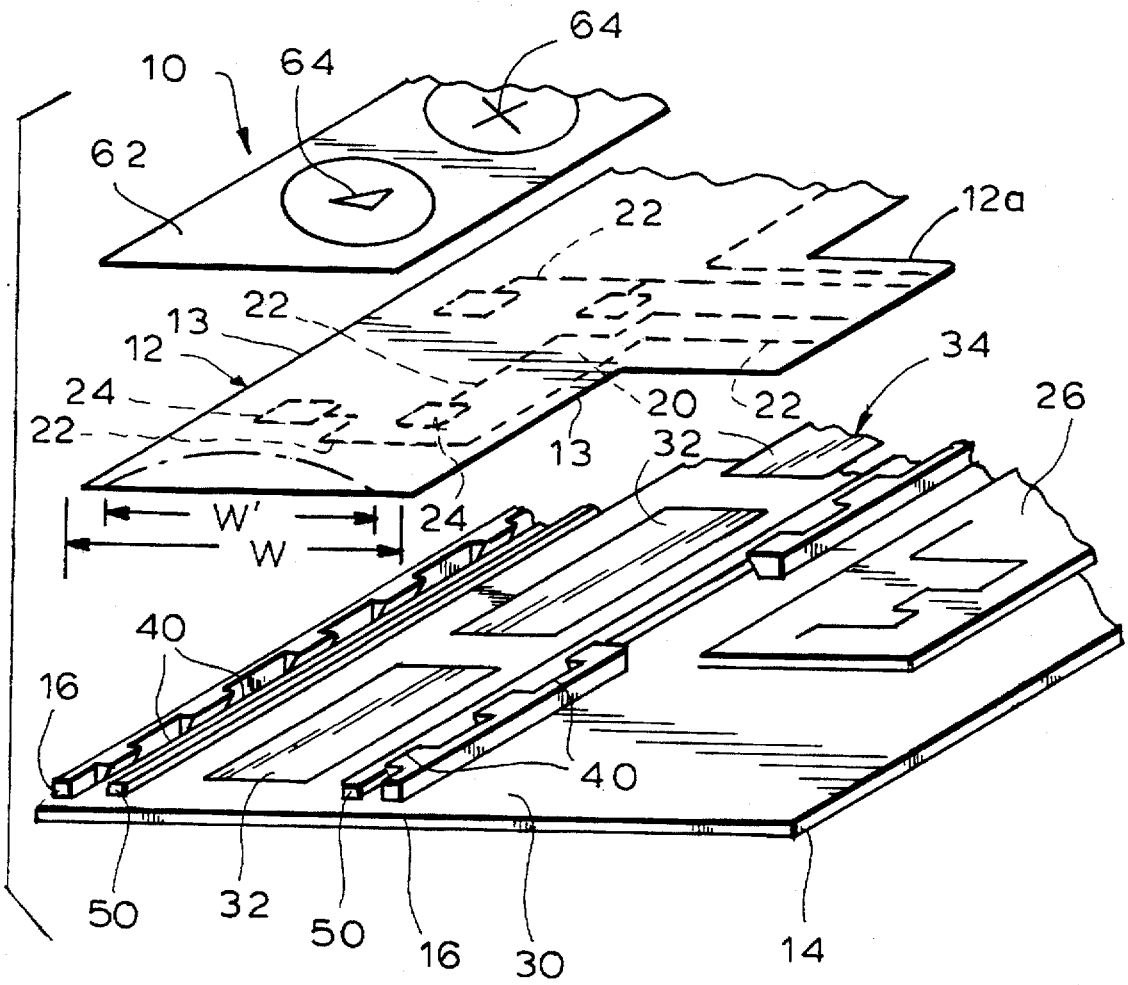
FIG. 5 is a view similar to FIG. 1, but of an alternative embodiment wherein the conductive shorting elements are longitudinally spaced apart.

The rigid substrate 14 defines on an oversurface 30 thereof (as opposed to its undersurface) a plurality of longitudinally aligned, conductive shorting elements 32. The conductive shorting elements 32 may be longitudinally spaced apart (as shown in FIG. 5) such that there is no electrical communication therebetween, but preferably the conductive shorting elements 32 define a uniform unitary conductive shorting pad, generally designated 34, as illustrated in FIG. 1.

The width of the conductive shorting pad 34 or each individual conductive shorting element 32 (transverse to the longitudinal axis of the assembly) is selected to ensure that it can establish electrical communication between a pair of laterally spaced conductive contacts 24 on the membrane undersurface 20. The length of the conductive shorting pad 34 or the length of each individual conductive shorting element 32 (along the longitudinal axis of the assembly) selected to ensure accommodation of the number of contact pairs 24 (taking into consideration the longitudinal spacing between the contact pairs 24). The number of contact pairs 24 disposed on a given longitudinal length of the membrane 12 (including the longitudinal spacing therebetween) is in turn selected to enable proper operation of the membrane 12—that is, operation of the membrane 12 such that depression of the membrane to effect the closure of one switch will not also accidentally effect the closure of an adjacent switch.

The rigid substrate 14 is typically a part of the switch housing with the conductive shorting pad 34 preferably resting partially or entirely in a depression in the uppersurface 30 thereof.

It will be appreciated by those skilled in the membrane switch art that the electrically conductive features of the membrane 12 (that is, the interrupted circuits 22 and contacts 24 thereof) and the rigid substrate 14 (that is, the conductive shorting elements 32 thereof) may be interchanged, if desired. Thus the plurality of longitudinally aligned, conductive shorting elements 32 (or the conductive shorting pad 34) may be disposed on the membrane undersurface 20 while the plurality of interrupted circuits 22 defining longitudinally aligned pairs of laterally spaced, conductive contacts 24 may be disposed on the rigid substrate oversurface 30, although the former arrangement is preferred.

The laterally spaced pair of longitudinally extending, non-conductive positioning ribs 16 are disposed on the oversurface 30 of the rigid substrate 14. They may be either secured directly to the rigid substrate oversurface 30, as illustrated, or otherwise maintained in position by the switch housing. Each positioning rib 16 defines means 40 for receiving and maintaining a longitudinally extending edge of the membrane 12. The receiving and maintaining means is preferably an undercut 40 on the positioning rib 16, with the undercuts releasably receiving and maintaining the membrane 16 in a convexly bowed cross section. Optimally, as illustrated, each positioning rib 16 defines a plurality of intermittent undercuts 40. When intermittent undercuts 40 are employed, the undercuts are preferably about 3 mm in length with a separation of about 12 mm therebetween (along the longitudinal axis of the assembly). One of the positioning ribs 16 may be interrupted to enable passage of the membrane extension 12*a* therethrough on its way to the printed circuit board or other electronic circuit 26.

The convex bowing of the membrane 12 occurs when the width W of the membrane 12, when flat, exceeds the lateral distance between the undercuts 44 of the respective positioning ribs 16, as discussed hereinabove. Preferably, the width of the flat membrane 12 (from one longitudinal edge 13 to the other longitudinal edge 13) is about 35 mm and exceeds the maximum lateral distance of 33.5 mm between the undercuts of the two positioning ribs 16, preferably by about 3.5 to 5.0% of the flat membrane width or 1.5 millimeters. Clearly other differences between the membrane width and the undercut lateral spacing will be appropriate for different materials, different membrane widths, and the like. The resilient flexibility of the membrane 12 enables it to be bent into a sharply convexly bowed configuration, inserted between the positioning ribs 16 and then released from the strongly convexly bowed configuration, so that the longitudinal edges 13 thereof will be received within the undercuts 44 of the respective positioning ribs 16 to maintain a less extreme but still effective convex bowing for the purposes of the present invention. The lateral spacing or width W' between the longitudinal edges 13 of the bowed membrane 12 is less than the width W of the flat membrance.

As used herein and in the claims, the description of the membrane 12 as "having a convexly bowed cross section" means that the cross section, for substantially its entire length between the membrane ends, is uniformly convexly bowed and that the membrane is not merely convexly bowed at a few points along its length or differently bowed at different points. In other words, while a hemispherical membrane has a convexly bowed cross section, that convexly bowed cross section is not uniform along substantially the entire length thereof.

Routine experimentation will easily and quickly determine the degree of convex bowing of the membrane 12 which is required to isolate the electrical components of a single switch from one another (that is, the contacts 24 on membrane 12 from the conductive shorting element 32 on the rigid substrate 14) and to isolate one switch from adjacent switches along the longitudinal axis of the assembly 10.

Preferably, each pair of contacts 24 should be separated from each adjacent pair of contacts 24 along the longitudinal axis of the assembly 10 by a longitudinal distance of at least 2 mm, thereby to ensure isolation of each switch from the adjacent switches. The optimum longitudinal separation between switches will depend upon such factors as the composition of the membrane, size of the contacts 24, and the like.

In a preferred embodiment of the present invention, a laterally spaced pair of longitudinally extending, non-conductive guide ribs 50 are disposed on the upper surface 30 of the rigid substrate 14. The guide ribs 50 are typically rails of rectangular cross section which are disposed closely adjacent and inwardly of the positioning ribs 16, such that the longitudinal edges of the membrane 12 passes over the guide ribs 50 and under the positioning rib undercuts 40. The guide ribs 50 cooperate with the positioning ribs 16 to maintain the membrane 12 uniformly convexly bowed throughout its length. The precise convexity of the bowing of membrane 12 will depend upon the angle of the undercuts 44 and the height of the guide ribs 50 and the closeness of the guide ribs 50 and the positioning ribs 16. However, to minimize wear of the membrane 12, preferably the angle of the undercuts 44 of the positioning ribs 16 determines the extent of the normal convex bowing of the membrane 12, with the guide ribs 50 coming into play as an adjunct only when the adjacent membrane portion is depressed to activate the switch.

Preferably the assembly 10 includes a flexible label 62 which is disposed over the membrane 12 and bears a printed icon 64 over each of the conductive shorting elements 32. Thus, when the icon 64 is depressed, a pair of contacts 24 on the membrane 12 is forced against the opposed or underlying conductive shorting element 32, thereby closing the switch and effecting electrical communication between the contacts 24 of the interrupted circuit 22 involved. The label 62 may be adhesively or otherwise secured to the uppersurface of membrane 12 and is, like the membrane 12, convexly bowed in cross section in the final assembly. Alternatively, the label 62 may be held in place by the switch housing.

To summarize, the present invention provides a multi-switch membrane-switch assembly which does not require either horizontal or vertical spacers in order to isolate one switch from another or to isolate the electrical components of a single switch from one another.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A multi-switch membrane-switch assembly comprising:

(A) a longitudinally extending, resiliently flexible, non-conductive membrane having a convexly bowed cross section defining on an undersurface thereof a plurality of interrupted circuits defining longitudinally aligned pairs of laterally spaced, conductive contacts;

(B) a rigid substrate defining on an oversurface thereof a plurality of longitudinally aligned, conductive shorting elements; and (C) a laterally spaced pair of longitudinally extending, non-conductive positioning ribs on the oversurface of said rigid substrate, each positioning rib defining means for receiving and maintaining a longitudinally extending edge of said membrane, and said positioning ribs cooperating to maintain said membrane convexly bowed;

said assembly being characterized by the absence of any horizontal spacer isolating one of a pair of said laterally spaced conductive contacts from the other of the pair or one of said conductive shorting elements from another, and by the absence of any vertical spacer isolating any pair of said laterally spaced conductive contacts from any one of said conductive shorting elements.

2. The assembly of claim 1 wherein said receiving and maintaining means is an undercut on said positioning rib.

3. The assembly of claim 2 wherein the width of said membrane, when flat, exceeds the lateral distance between said undercuts of said positioning ribs.

4. The assembly of claim 3 wherein the width of said membrane, when flat, exceeds the lateral distance between said undercuts of said positioning ribs by about 3.5 to 5.0% of said membrane when flat.

5. The assembly of claim 2 wherein said undercuts releasably receive and maintain said membrane.

6. The assembly of claim 1 wherein each of said positioning ribs defines a plurality of intermittent undercuts.

7. The assembly of claim 1 wherein said plurality of conductive shorting elements are longitudinally spaced apart.

8. The assembly of claim 1 wherein said plurality of conductive shorting elements define a unitary conductive shorting pad.

9. The assembly of claim 1 additionally including a label disposed on an oversurface of said membrane, said label bearing a printed icon over each of said conductive shorting elements.

10. The assembly of claim 1 wherein said rigid substrate is a switch housing.

11. The assembly of claim 1 additionally including a laterally spaced pair of longitudinally extending, non-conductive guide ribs on the oversurface of said rigid substrate, said guide ribs being disposed closely adjacent and inwardly of said positioning ribs and cooperating with said positioning ribs to maintain said membrane convexly bowed.

12. The assembly of claim 1 wherein said membrane is mylar.

13. The assembly of claim 1 wherein said membrane is polyester.

14. A multi-switch membrane-switch assembly comprising:

(A) a longitudinally extending, resiliently flexible, non-conductive membrane formed of polyester having a convexly bowed cross section defining on an undersurface thereof a plurality of interrupted circuits defining longitudinally aligned pairs of laterally spaced, conductive contacts;

(B) a switch housing having a rigid substrate defining on an oversurface thereof a unitary conductive shorting pad including a plurality of longitudinally aligned, conductive shorting elements;

(C) a laterally spaced pair of longitudinally extending, non-conductive positioning ribs on the oversurface of said rigid substrate, each positioning rib defining a plurality of intermittent undercuts for releasably receiving and maintaining a longitudinally extending edge of said membrane, and said positioning ribs cooperating to maintain said membrane convexly bowed; and (D) a laterally spaced pair of longitudinally extending, non-conductive guide ribs on the oversurface of said rigid substrate, said guide ribs being disposed closely adjacent and inwardly of said positioning ribs and cooperating with said positioning ribs to maintain said membrane convexly bowed;

the width of said membrane, when flat, exceeding the lateral distance between said undercuts of said positioning ribs;

said assembly being characterized by the absence of any horizontal spacer isolating one of a pair of said laterally spaced conductive contacts from the other of the pair or one of said conductive shorting elements from another, and by the absence of any vertical spacer isolating any pair of said laterally spaced conductive contacts from any one of said conductive shorting elements.

15. A multi-switch membrane-switch assembly comprising:

(A) a longitudinally extending, resiliently flexible, non-conductive membrane having a convexly bowed cross section defining on an undersurface thereof one plurality of (a) a plurality of interrupted circuits defining longitudinally aligned pairs of laterally spaced, conductive contacts, and (b) a plurality of longitudinally aligned, conductive shorting elements;

(B) a rigid substrate defining on an oversurface thereof the other plurality; and (C) a laterally spaced pair of longitudinally extending, non-conductive positioning ribs on the oversurface of said rigid substrate, each positioning rib defining means for receiving and maintaining a longitudinally extending edge of said membrane, and said positioning ribs cooperating to maintain said membrane convexly bowed;

said assembly being characterized by the absence of any horizontal spacer isolating one of a pair of said laterally spaced conductive contacts from the other of the pair or one of said conductive shorting elements from another, and by the absence of any vertical spacer isolating any pair of said laterally spaced conductive contacts from any one of said conductive shorting elements.

* * * * *